United States Patent [19]

Apgar

[11] Patent Number: 4,974,496

[45] Date of Patent: Dec. 4, 1990

[54] A HYDROCYCLIC MOTOR

[75] Inventor: William J. Apgar, Duncraig, Australia

[73] Assignee: Sea Shelf Engineering Pty. Ltd., Duncraig, Australia

[21] Appl. No.: 302,749

[22] PCT Filed: Jul. 23, 1987

[86] PCT No.: PCT/AU87/00231

§ 371 Date: Jan. 23, 1989

§ 102(e) Date: Jan. 23, 1989

[87] PCT Pub. No.: WO88/00639

PCT Pub. Date: Jan. 28, 1988

[30] Foreign Application Priority Data

Jul. 23, 1986 [AU] Australia ..... PH7090

[51] Int. Cl.[5] ..... F01B 1/06; F03C 1/041; F04B 1/04

[52] U.S. Cl. ..... 91/491; 92/58

[58] Field of Search ..... 91/491–495; 92/58

[56] References Cited

U.S. PATENT DOCUMENTS

| | | | |
|---|---|---|---|
| 2,698,585 | 1/1955 | Cotner et al. | 91/491 X |
| 2,716,944 | 9/1955 | Ferris | 91/491 X |
| 2,737,122 | 3/1956 | Tacconi | 91/495 X |
| 2,939,403 | 6/1960 | Von Soden | 91/494 |
| 2,967,490 | 1/1961 | Von Soden | 91/495 |
| 3,058,429 | 10/1962 | Rocheville | 91/495 |
| 3,084,562 | 4/1963 | Fitzpatrick | 91/495 |
| 3,762,488 | 10/1973 | Dammon | 91/494 X |
| 3,827,338 | 8/1974 | Oguni et al. | 91/491 |
| 4,003,351 | 1/1977 | Gunther | 92/58 X |
| 4,522,110 | 6/1985 | Samuelsson | 91/491 X |

*Primary Examiner*—Leonard E. Smith

*Attorney, Agent, or Firm*—Kerkam, Stowell, Kondracki & Clarke

[57] ABSTRACT

A fluid motor which is useful as a pump or as an hydraulic or pneumatic engine with a high torque low speed output. The fluid motor (10) comprises at least one drive disc (24) having a generally curved outer surface (42), at least one reciprocably mounted piston (26), the outer curved surface of the drive disc (24) being formed of alternating crests (44) and valleys (46) and there being provided a plurality of rollers (48) which are arranged to engage with the curved surface (42) of the drive disc (24), the number of rollers (48) and the number of crests (44) being different by at least one. Feeding fluid to the piston (26) causes the piston (26) to reciprocate so that the disc (24) is caused to undergo orbital movement and the housing (12) is thus caused to rotate.

14 Claims, 3 Drawing Sheets

A HYDROCYCLIC MOTOR

FIELD OF THE INVENTION

The present invention relates to a fluid motor. The fluid motor of the present invention is a radial piston motor and speed reducer, with high torque low speed output. The motor of the present invention can be used as a pump or as an hydraulic or pneumatic engine.

SUMMARY OF THE INVENTION

In accordance with one aspect of the present invention there is provided a fluid motor characterized by a housing, at least one drive disc mounted within the housing, said drive disc having a generally curved outer surface, a central body disposed within said drive disc which central body is arranged to be attached to a fixed structure, at least one piston reciprocally mounted within the central body, a connecting rod connecting the piston to an eccentrically disposed crank, the eccentrically disposed crank being operatively connected to an eccentric nested, in the drive disc, the outer curved surface of the drive disc being formed of alternating crests and valleys and the housing having mounted in its interior adjacent its periphery a plurality of rollers which are arranged to engage with the curved surface of the drive disc, the number of rollers and the number of crests being different by at least one, and means being provided for feeding fluid to the or each piston to cause the or each piston to reciprocate so that the or each eccentric crank is caused to rotate about a respective central axis. The drive disc is caused to undergo a corresponding orbital movement by the corresponding eccentric or eccentrics and the housing is thus caused, through interaction between the curved surface of the drive disc and the rollers to rotate.

BRIEF DESCRIPTION OF THE DRAWINGS

The present invention will now be described, by way of example with reference to the accompanying drawings, in which.

DESCRIPTION OF THE INVENTION

Figure 1:
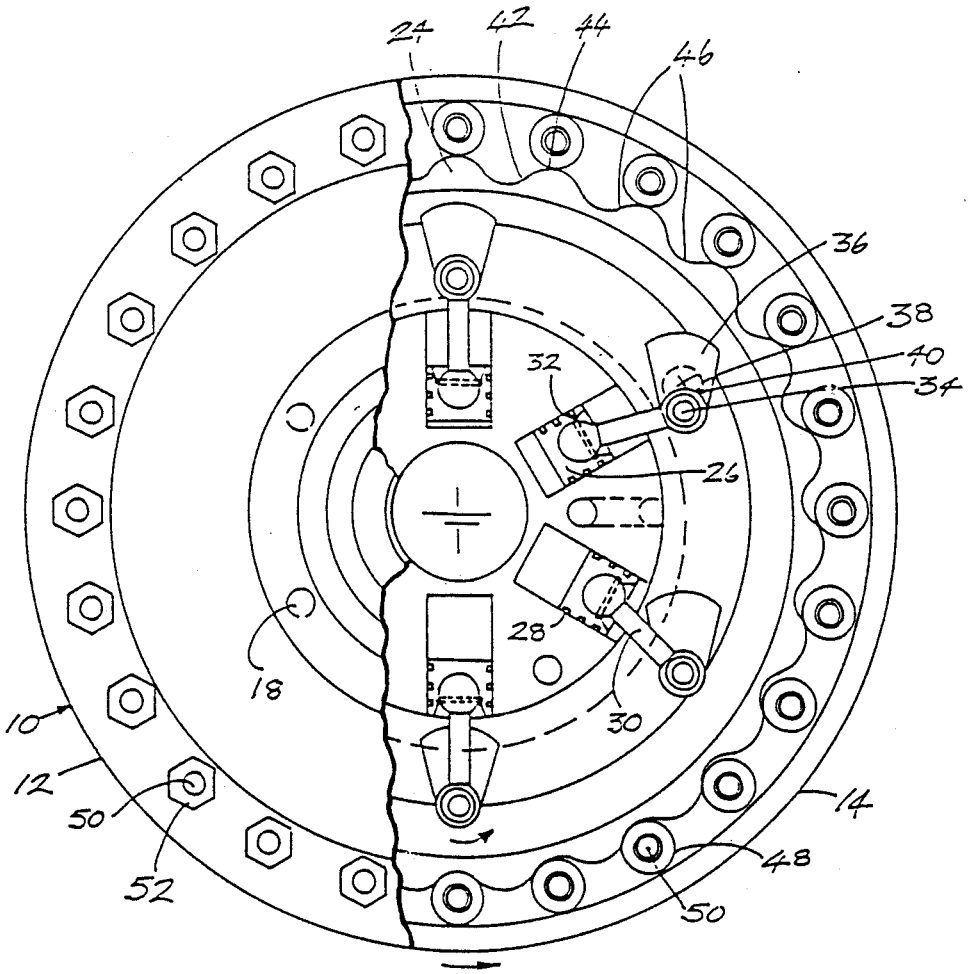
FIG. 1 is a front view, partly in section along the line A—A of FIG. 2, of a fluid motor in accordance with the present invention.
Figure 2:
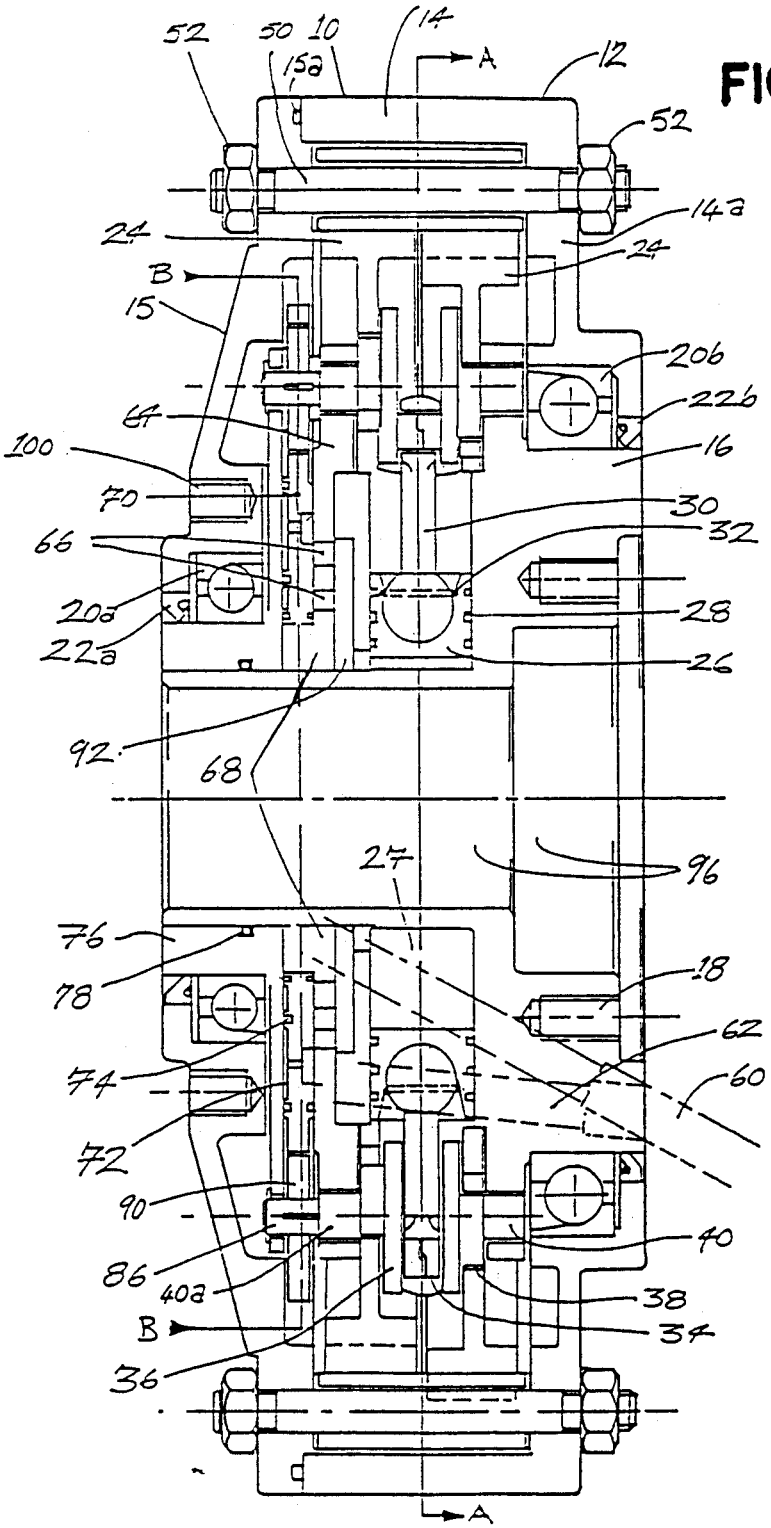
FIG. 2 is a front to rear section through the motor of FIG. 1.

In FIGS. 1 and 2, there is shown a fluid motor 10 comprising an outer housing 12 which is of generally cylindrical shape. The outer housing 12 is comprised of an outer curved wall 14 and a back wall 14*a* and a front cover 15 with a seal 15*a* between them.

A central body 16 is fixed and is arranged to be mounted to a fixed structure by means of threaded engagement of studs with apertures 18. The outer housing 12 is rotatably mounted to the central body 16 by means of angular contact bearings 20*a* and 20*b*. Further, the junctions between the housing 12 and the body 16 on the outer sides of the bearings 20*a* and 20*b* are sealed by oil seals 22*a* and 22*b* respectively.

Within the housing 12 there is contained a pair of drive discs 24 which are so mounted as to move simultaneously. A plurality of radially extending pistons 26 are located in the body 16 and are arranged to be reciprocated therein as will be described hereinafter.

The pistons 26 may be cylindrical in shape but other shapes are possible. Further, the heads of the pistons 26 point to the centre of the motor 10. Still further, any number of pistons 26 can be used although an odd number is preferred to minimize dynamic resonance. Also, it is preferred that the motor 10 contain at least three pistons 26 to maintain orbital movement readily although the motor 10 could contain a larger number of pistons 26 .

Each piston is reciprocally mounted within a chamber 27 in the body 16 and is sealingly engaged with its respective chamber by means of piston rings 28. Further, each piston 26 is pivotally connected to a ball headed connecting rod 30. A pin connection can alternatively be used. Each piston 26 is retained in place on its respective connecting rod 30 by a locking ring 32 which engages with the distal side of the ball of the connecting rod 30 and a hollowed out portion of the piston 26. A vent hole may be provided in the piston 26 to allow cylinder fluid pressure to bear directly onto the ball surface of the connecting rod 30. The end of each connecting rod 30 remote from its piston 26 encircles a crank pin 34. A suitable bearing is located between the piston rod 30 and the crank pin 34. Each crank pin 34 is connected to opposed ends of a pair of spaced counter weights 36. On their outer sides the counter weights 36 are connected to respective eccentrics 38. The eccentrics 38 are nested in respective cycloid discs 24. Further, the eccentrics 38 are connected on their outer sides to crankshaft journals 40 and 49*a* which are mounted in the central body 16 and a port ring 64 (to be described) respectively. A suitable bearing supports each crankshaft journal 40 and 49*a*.

The cycloid discs 24 each have outer generally curved surfaces 42 which comprise a series of alternating crests or lobes 44 and valleys 46.

Further, a plurality of rollers 48 are mounted across the interior of the outer housing 12.

The rollers 48 are each rollably mounted on shafts 50 which extend through the back wall 14*a* and the front cover 15. The shafts 50 are retained in place by nuts 52 which are mounted externally of the outer housing 12 and are threadedly engaged with the shafts 50. As can be seen in FIG. 1, the crests 44 are of a height to engage with rollers 48. The fluid motor 10 as shown in the drawings comprises 24 rollers 48 and 23 crests 44 which create a reduction ration of 24:1.

The pistons 26 are driven by pressurized fluid such as hydraulic fluid o air which is distributed by internal ducts and a slide valve.

The apparatus further comprises an inlet duct 60 and an outlet duct 62. Adjacent the inner end of the inlet duct 60 there is located a port ring 64 which extends in annular manner around the central body 16 and which comprises a plurality of ports 66. The port ring 64 is located adjacent an annular oil gallery 68. The port ring 64 is rigidly attached to the central body 16 and becomes part of this body.

Further, an annular valve plate 70 is located about the oil gallery 68 and is arranged to control the flow of oil into the inlet and outlet ports 66*a* and 66*b* (See FIG. 3) as will be described.

Further, the valve plate 70 contains bleedholes 72 to equalize differential fluid pressure on either side thereof.

The valve plate 70 is sealed by valve seal rings 74. Still further, an annular support disc 76 is located on the outer side of the valve plate 70 so as to retain the latter in place. The support disc 76 is rigidly attached to the central body 16 and supports the bearing 20*a* and is sealingly engaged with the central body 16 by means of an '0' ring seal 78.

Figure 3:
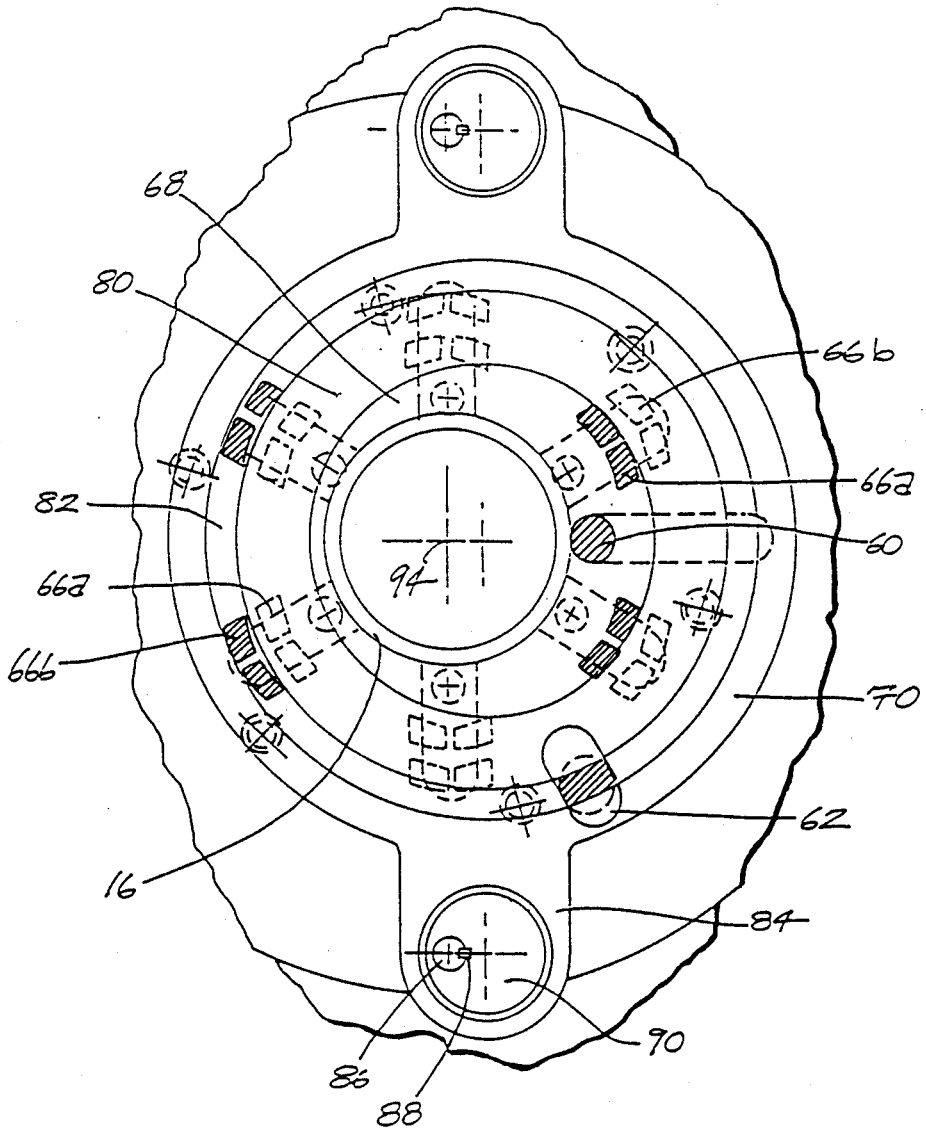
FIG. 3 is a section along the line B—B of FIG. 2 showing a valve mechanism.

The valve plate 70 is shown in more detail in FIG. 3. The valve plate 70 encloses the gallery 68 which is innermost adjacent the central body 16. The feed duct 60 leads into the gallery 68. Further, the valve plate 70 contains an eccentrically disposed annular member 80. A further oil gallery 82 is disposed externally of the annular member 80. The valve plate 70 is connected to a pair of opposed outwardly extending lugs 84.

Each lug 84 has an eccentrically located pin 90 mounted within it. Each pin 90 is connected by means of a key 88 to an extension 86 of a crank journal 40. Thus, the valve plate 70 is operatively connected to a pair of the plurality of pistons 26 such that when the crank journals 40 thereof are caused to rotate the valve plate 70 is caused to orbit about the extensions 86.

Further, as can be seen in FIG. 3, the apparatus includes an inlet port 66*a* and an outlet port 66*b* for each piston chamber 27 and a respective transfer duct 92 (FIG. 2) for in FIG. 3, at all positions of the valve plate 70 some of the inlet ports 66*a* are open and pressurized fluid is being passed from the inlet duct 60 through the port 66*a* into a duct 92 (See FIG. 2) and then into the chamber of one or more pistons 26. Further, some of the outlet ports 66*b* are also open and in this case low pressure fluid is being ejected from the chamber of these pistons 26 through the duct 92, to the outlet ports 66*b* and the outlet duct 62. Still further, some of the ports 66*a* and 66*b* for some of the pistons 26 are virtually closed off so that there is a minimum net inflow or outflow of fluid at the point in the cycle.

In operation, pressurized fluid is fed through the inlet duct 60 to the gallery 68. Then the fluid flows through those inlet ports 66*a* which are open into the corresponding duct 92 and then into the chambers of the corresponding pistons 26. The pressurized fluid pushes the piston back towards the position shown at the lower half of FIG. 2. At the same time other pistons at other stages in their cycle are moving towards the central body 16 towards the position shown at the upper half of FIG. 2 and ejecting fluid through the corresponding duct 92 and through the corresponding outlet port 66*b* which is open. The ejected fluid passes through the outlet duct 62 to a drain of low pressure fluid.

The valve plate 70 moves around a central axis 94 under control of the eccentric pins 90 and the extensions 86 as the latter are rotated by reciprocal movement of the pistons 26.

The movement of the valve plate 70 sequentially opens and closes the inlet ports 60*a* and also simultaneously sequentially opens and closes the outlet ports 66*b* to enable fluid to be admitted and discharged as described above. Further, the pistons 26 are so arranged to coordinate their cycles with the opening and closing of the ports in the sense that fluid commences to be fed to a chamber of a piston 26 when the latter is close to top dead centre and fluid commences to be expelled from a chamber of a piston 26 when the latter is close to bottom dead centre. The reciprocal movement of each piston 26 causes its corresponding crank 34 to be rotated which causes a corresponding rotation of the eccentrics 38. The eccentrics 38 rotate about a small circle. The net result of the rotation of all of the eccentrics 38 about circumferences of small circles causes each point on the periphery of the cycloid discs 42 to orbit through a small circle in the anti-clockwise direction as seen in FIG. 1. Thus, where the surface 42 adjacent a crest 44 contacts a roller 48 there is an impulse imparted to the roller 48 in the anti-clockwise direction. This tends to push the housing 12 in the anti-clockwise direction as shown by the lowermost arrow in FIG. 1.

Further, the orbital movements of the cycloid discs 24 described above enables each of the 23 crests 44 to be passed by each of the 24 rollers 48 in sequence. It is found that with the arrangement shown in the drawings twenty four cycles of each of the pistons 26 are required to be completed for each revolution of the housing 12 which corresponds with a gear reduction of 24:1. Other gear reduction ratios are possible by changing, for example, the cycloid discs 24 and the spacing of the rollers 48 or by altering numerical difference between the number of crests 44 and rollers 50. There may be less rollers 50 than crests 44 and vice versa.

It is found that the housing 12 may be caused to rotate at up to about 50 r.p.m. with the arrangement shown in the drawing, although higher speeds are possible. Further, the rollers 48 and drive discs 24 could be replaced by a gear tooth arrangement.

The port ring 64 of the illustrated embodiment is a replaceable component which provides one wear or contact face for the valve plate 70 whilst the support disc 76 is also a replaceable part and provides the other wear or contact face for the valve plate 70 which is itself also replaceable.

In the illustrated embodiment there are two drive discs 24 which are 180 degrees out of phase with one another which gives a good static balance and division of the drive forces in opposite sides of the housing 12. Other numbers of discs 24 are possible.

Further, the illustrated embodiment can be reversed in its travel by reversing the flow of fluid.

The outer curved surface of the housing 12 may be used as a brake drum for a band brake. Further, a driven member may be connected to the housing 12 by means of threaded holes 100.

A central hole 96 is provided for convenience of installation but has no other functional purpose. Modifications and variations such as would be apparent to a skilled addressee are deemed within the scope of the present invention.

I claim:

1. A fluid motor characterized by a housing, at least one drive disc mounted within the housing, said drive disc having a generally curved outer surface a central body disposed within said drive disc which central body is arranged to be attached to a fixed structure, at least one piston reciprocally mounted within the central body, a connecting rod connecting the piston to an eccentrically disposed crank, the eccentrically disposed crank being operatively connected to an eccentric nested in the drive disc, the outer curved surface of the drive disc being formed of alternating crests and valleys and the housing having mounted on its interior adjacent its periphery a plurality of rollers which are arranged to engage with the curved surface of the drive disc, the number of rollers and the number of crests being different by at least one, and means being provided for feeding fluid to the or each piston to cause the or each piston to reciprocate so that the or each eccentric crank is caused to rotate about a respective central axis, the drive disc is caused to undergo a corresponding orbital movement by the corresponding eccentric or eccentrics and the housing is thus caused, through interaction between the curved surface of the drive disc and the rollers to rotate.

2. A fluid motor according to claim 1, characterized in that it comprises an odd number of pistons.

3. A fluid motor according to claim 1 or 2, characterized in that it comprises at least three of the pistons.

4. A fluid motor according to claim 3 characterized in that it comprises a pair of drive discs driven by common piston means, said pair of discs being out of phase with one another.

5. A fluid motor according to claim 4 characterized in that the or each piston is sealingly and reciprocally mounted in a chamber containing an inlet port for pressurized fluid and an outlet port for low pressure fluid.

6. A fluid motor according to claim 5 characterized in that the pistons are radially extending with the heads of the pistons facing towards a central axis of the fluid motor.

7. A fluid motor according to claim 5 or 6, characterized in that the or each eccentrically disposed crank comprises a crank-pin connected to an end of a counterweight, the counterweight being connected at a point spaced from the crank-pin, to a corresponding said eccentric which is nested in a said drive disc.

8. A fluid motor according to claim 7, characterized in that the eccentric is also connected to a crankshaft journal which is mounted in the central body.

9. A fluid motor according to claim 8 characterized in that it further comprises an inlet duct and an outlet duct for fluid, port means for passing the fluid to and from the inlet and outlet ducts, and valve means for controlling the flow of fluid to and from the chambers of the pistons.

10. A fluid motor according to claim 9, characterized in that the port means are contained in a port ring disposed about the central body and fluid gallery means is disposed adjacent the port ring in communication with the port means.

11. A fluid motor according to claim 10, characterized in that there is provided an annular valve plate disposed about a respective central axis in engagement with the port ring and having galleries disposed internally and externally of it which valve plate is arranged to control the flow of oil into and out of the chamber of the or each piston.

12. A fluid motor according to claim 11, characterized in that the valve plate is retained in place by an annular support disc on the opposite side thereof from the port ring.

13. A fluid motor according to claim 12 or 13, in which the valve plate comprises outwardly extending lug means eccentrically connected to a rotatable member so as to orbit adjacent the port ring such that the inlet and outlet ports of the chambers of the pistons are opened and closed sequentially in a manner coordinated with the positions of the pistons.

14. A fluid motor according to claim 13, in which the valve plate contains an opposed pair of outwardly extending lug means.

* * * * *

UNITED STATES PATENT AND TRADEMARK OFFICE

CERTIFICATE OF CORRECTION

PATENT NO. : 4,974,496

DATED : December 4, 1990

INVENTOR(S) : William J. APGAR

It is certified that error appears in the above-identified patent and that said Letters Patent is hereby corrected as shown below:

In column 2, line 51 thereof: delete "fluid o air" and substitute therefor -- fluid or air --.

In column 5, line 1 of claim 3: delete "or 2".
(line 8)

Signed and Sealed this

Fifth Day of May, 1992

*Attest:*

DOUGLAS B. COMER

*Attesting Officer*

*Acting Commissioner of Patents and Trademarks*